United States Patent [19]

Plyler

[11] Patent Number: 4,653,841

[45] Date of Patent: Mar. 31, 1987

[54] LOW PROFILE WEDGE BASE LAMP BULB SOCKET ASSEMBLY

[75] Inventor: Robert G. Plyler, Vienna, Charles R. Nestor, Niles, both of Ohio

[73] Assignees: General Motors Corporation, Detroit, Mich. Charles R. Nestor, Niles

[21] Appl. No.: 829,158

[22] Filed: Feb. 14, 1986

[51] Int. Cl.[4] ..... H01R 13/11

[52] U.S. Cl. ..... 339/176 L; 339/254 R

[58] Field of Search ..... 339/176 L, 254, 256 R

[56] References Cited

U.S. PATENT DOCUMENTS 2,599,361 6/1952 Beal ..... 339/254 R 4,573,754 3/1986 Hill ..... 339/176 L

*Primary Examiner*—Joseph H. McGlynn

*Attorney, Agent, or Firm*—Patrick M. Griffin

[57] ABSTRACT

A low profile socket assembly is provided for use with a wedge base type lamp bulb that has a reduced number of parts while providing uniform and reliable electrical contact. The socket assembly includes a housing having a socket adapted to receive the lamp bulb base, and a pair of substantially cylindrical barrel terminals. The barrel terminals are uniformly radially inwardly compressible without substantial resistance, and receivable within the housing so as to present a uniform contact surface through the walls of the housing socket regardless of the orientation of the terminals. The terminals are thereby uniformly compressible between the filament contact wires and the inner surfaces of the terminal passages by the opposed sides of the lamp bulb base when the lamp bulb base is received into the socket, thereby making uniform and reliable electrical contact with the lamp bulb.

3 Claims, 4 Drawing Figures

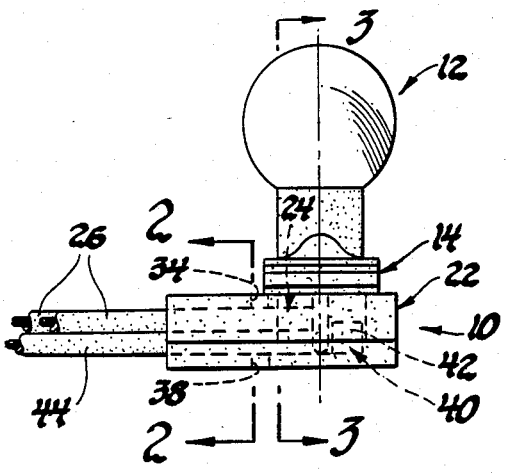
Fig.1
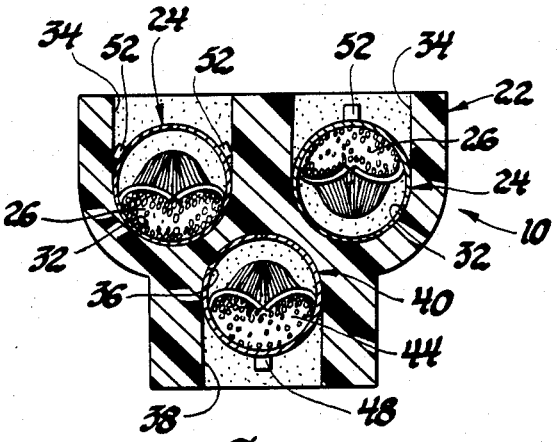
Fig.2
Fig.3
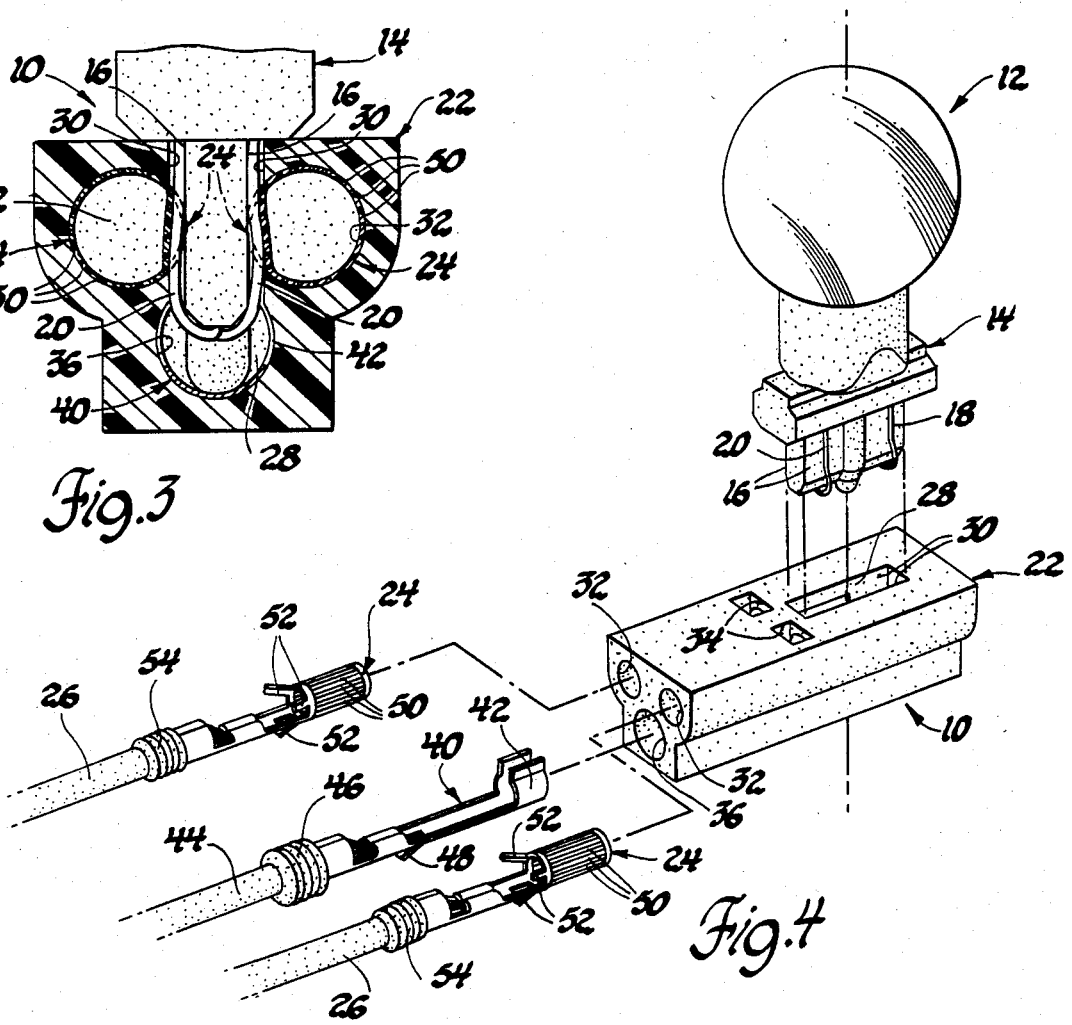
Fig.4

LOW PROFILE WEDGE BASE LAMP BULB SOCKET ASSEMBLY

This application relates to lamp bulb socket assemblies in general, and specifically to a low profile socket assembly for a wedge base type lamp bulb.

BACKGROUND OF THE INVENTION

Lamp bulbs used in vehicles have traditionally included bulbs with cylindrical metal threaded bases, or bayonet bases. These bulbs are used with a socket assembly that includes generally a housing with a socket, terminals internal to the housing, and circuit wires joined to the terminals that exit the housing and are connected to the rest of the vehicle's electrical system. The bases of such lamp bulbs received into the socket by threading, or with a partial turn twist. Increasingly, however, wedge base type bulbs are being used. A wedge base bulb includes a base formed of the same glass as the lamp bulb itself and having generally the shape of a rectangular prism, with opposed parallel sides. Filament contact wires are located against, or at least proximate to, the opposed base sides, and extend along the base sides essentially parallel to the central axis of the bulb itself. The filament contact wires are extensions of the internal bulb filament and are relatively thin and delicate, as compared to a metal bayonet base. The advantage of the wedge base bulb, however, is that it may be received into the housing socket by simply being pushed down in a straight path, generally along the central axis of the bulb. This is simpler than the threading action or the quarter turn necessary with other bulbs. As the wedge base bulb is so received, terminals internal to the housing make electrical contact with the filament contact wires. Consequently, it is common for at least that part of the terminal that physically engages the filament contact wires to be oriented substantially parallel to the straight line path followed by the bulb base as it is so received. Then, the terminals may wipe along the filament contact wires, pressing them against the opposed sides of the bulb base without damaging or moving them out of position.

The two basic types of socket assemblies for receiving a wedge base lamp bulb are "in-line" and "low profile" . In an in-line socket assembly, the whole of each terminal is essentially straight, and the circuit wires are colinear with the terminals. Therefore, the terminals and circuit wires together may be simply placed inside the housing through terminal passages formed in the housing that extend substantially parallel to the bulb axis, that is, parallel to the straight path followed by the bulb base as it is received. Such a terminal passage need not be much wider than the terminal that it receives, and will be relatively easy to seal. A good example of a typical in-line socket assembly may be seen in the U.S. Pat. No. 3,950,061 to Kausen. There, a straight terminal 76 and its colinear circuit wire 74 are received in a relatively narrow cylindrical passage 72 in housing 42, a passage that is parallel to the central axis of the bulb 10. The drawback of an in-line assembly is that it inevitably occupies a large amount of axial space, as measured along the axis of the bulb.

In a low profile socket assembly, the circuit wire is made to exit the housing perpendicularly to the axis of the bulb, thus saving axial space. One way to create this low profile is to separately attach the circuit wire to the terminal, after the terminal is already inside the housing. An example of this type of low profile assembly may be seen in the U.S. Pat. No. 3,676,834 to Kaldor et al. However, this kind of plug in circuit wire connection is inherently not as sound as when the circuit wire is solidly crimped to the terminal first. But, if a terminal and ninety degree circuit wire are to be placed together, as a unit, through a passage into a housing, in the same fashion as in an in-line socket assembly, then the terminal passage will have to be as wide as the length of the terminal. This would require a very large passage opening, which would be very difficult to seal, as well as potentially weakening the housing. One obvious solution to this problem is to simply integrally mold the terminal and ninety degree circuit wire together into the housing, but this is clearly not preferred, because of servicability problems. Other known solutions include making the terminal in two parts, one part internal to the housing and oriented parallel to the bulb axis, and another part perpendicular to the first part. The second part of the terminal is separately received into the housing through a relatively narrow passage to connect it to the first part. An example of this type of low profile assembly may be seen in the U.S. Pat. No. 4,418,973 to Smetan et al. Clearly, a two part terminal is less desirable that a unitary terminal. One distinctive solution to the problem may be found in the U.S. Pat. No. 4,101,187 to Collier, which discloses a hollow, L shaped plastic housing molded so as to open like a book, with a living hinge. An L shaped terminal and attached ninety degree circuit wire may be placed inside, and the housing closed. Besides being difficult to mold, such a housing is undesirable because of the large perimeter seam that it would leave, which would be difficult to seal.

SUMMARY OF THE INVENTION

The subject invention provides a low profile socket assembly for use with a wedge base lamp bulb that overcomes the above noted shortcomings, while providing for a reduced number of parts and a uniform and reliable electrical contact.

The subject low profile socket assembly is used with a typical wedge base bulb, one that has a base with opposed sides and filament contact elements or wires located externally of the opposed base sides. The socket assembly has a small number of component parts, which basically includes a housing, and at least one terminal of a particular design, two such terminals in the preferred embodiment. The housing is molded in one piece of plastic or other suitable dielectric material with a central socket. The housing socket includes a pair of opposed walls, one respective to each opposed side of the lamp bulb base, and spaced apart an amount slightly greater that the thickness of the bulb base. The socket is thus adapted to receive the lamp bulb base along a generally straight path, a path generally along the central axis of the lamp bulb. The housing also includes a pair of terminal passages with substantially cylindrical inner surfaces that open through one end of the housing to the socket. Each of the terminal passages has an axial orientation that is substantially perpendicular to the path of the lamp bulb base, and parallel to the socket walls. This orientation of the terminal passages allows each one of them to open laterally and longitudinally through a respective one of the socket walls. The orientation also allows the circuit wires that are attached to the terminals to exit the housing perpendicular to the axis of the bulb, giving a low profile, space saving assembly. Furthermore, each terminal passage has a slot opening through its inner surface.

The terminals of the socket assembly of the invention are substantially cylindrical and hollow, roll formed in one piece of a suitably conductive material. Each terminal is formed with a plurality of axial slits therein, extending from end to end thereof. Thus, the terminals may be uniformly radially inwardly compressed without substantial resistance. Each of the terminals has a diameter such that it is closely receivable within one of the terminal passages. Each terminal also has a plurality of circumferentially spaced tangs near its inner end that extend radially outwardly therefrom. These tangs number three, and are spaced approximately one hundred and twenty degrees apart. When received within the terminal passages, the terminals present a uniform contact surface through the socket walls to the socket, regardless of the orientation of the terminals in the terminal passages. In addition, the number of tangs is sufficient that at least one is resiliently captured in each terminal passage slot when the terminal is fully seated within the passage, regardless of the terminal orientation, thereby retaining the terminals in place axially.

When the bulb base is received in the socket, it moves between the terminals, and the filament contact wires on both sides of the base wipe across the presented contact surface of the terminals, moving perpendicular to the axis of the terminals. Both terminals are thereby uniformly radially inwardly compressed between the filament contact wires and the inner surfaces of the terminal passages, by the opposed sides of the lamp bulb base. Thus, a uniform and reliable electrical contact is made with the lamp bulb.

It is, therefore, a broad object of the invention to provide a low profile socket assembly for use with a lamp bulb of the type having a base with a contact element located externally on a side of the base, a socket assembly that has a reduced number of parts while providing uniform and reliable electrical contact with the lamp bulb.

It is another object of the invention to provide a socket assembly with the above noted advantages that includes a one piece housing having a socket therein that has a pair of opposed walls, one will respective to each opposed side of the lamp bulb base and thereby adapted to receive the lamp bulb base along a generally straight path, a housing which further includes a terminal passage with a substantially cylindrical inner surface and an axial orientation that is substantially perpendicular to the path of the lamp bulb base and parallel to the socket walls so as to provide a low profile assembly, an orientation which also allows the terminal passage to open laterally and longitudinally through one of the socket walls, and which also includes a substantially cylindrical and hollow one piece conductive terminal with a plurality of axial slits therein so as to be radially inwardly compressible without substantial resistance, a terminal that is also sized to be closely receivable within the terminal passage so as to be receivable into the housing with a uniform contact surface of the terminal presented through the housing socket wall to the socket regardless of the orientation of the terminal in the terminal passage, so that the terminal is uniformly compressible between the contact element and the inner surface of the terminal passage by the side of the lamp bulb base when the lamp bulb base is received into the socket, thereby making uniform and reliable electrical contact with the lamp bulb.

It is yet another object of the invention to provide a socket assembly of the type described above that includes two such terminal passages and two terminals receivable therein, so as to present a uniform contact surface through both housing socket walls to the socket, whereby the terminals are uniformly compressible by the opposed sides of the lamp bulb base between the contact elements and the inner surfaces of both terminal passages when the lamp bulb base is received into the socket between the terminals.

It is still another object of the invention to provide a socket assembly of the type described above in which each of the terminal passages also has a slot opening through its inner surface, and in which each of the terminals also has a sufficient number of circumferentially spaced flexible tangs extending radially outwardly therefrom so that, when the terminals are received within the terminal passages, at least one of the flexible tangs is resiliently captured within the terminal passage slot to retain the terminals in the terminal passages regardless of the orientation of the terminals.

BRIEF DESCRIPTION OF THE DRAWINGS

These and other objects and features of the invention will appear from the following written description and accompanying drawings, in which:

FIG. 1 is a side view of the socket assembly of the invention with a wedge base lamp bulb received therein;

FIG. 2 is an enlarged sectional view taken along the line 2—2 of FIG. 1;

FIG. 3 is an enlarged sectional view taken along the line 3—3 of FIG. 1, showing the uncompressed position of the two terminals of the invention in dotted lines and the compressed position in solid lines;

FIG. 4 is an exploded perspective view of the various components of the invention.

DESCRIPTION OF THE PREFERRED EMBODIMENT

Referring first to FIGS. 1, 3 and 4, the preferred embodiment of the low profile socket assembly of the invention is designated generally at 10. The invention is used with a typical wedge base lamp bulb, designated generally at 12. Bulb 12 includes a base, designated generally at 14 that is formed from the same glass as the bulb 12 itself with generally the shape of a rectangular prism. Base 14 has a pair of opposed, generally flat sides 16, one of which is visible in FIG. 4. Contact elements in the form of right and left pairs of filament contact wires, numbered 18 and 20 respectively, exit the bulb 12 through the bottom of base 14 and turn up along each of the base sides 16. The filament contact wires 18 and 20 are slightly arcuate, as best seen in FIG. 3, and stand out slightly from the base sides 16 near the bottom of base 14, but rest against the sides 16 near the top of base 14. Both pairs of filament contact wires 18 and 20 are fused at their free ends to base 14, but are still relatively delicate as compared to the cylindrical metal base of a typical metal bayonet lamp bulb base. The right pair of filament contact wires 18 forms the ground electrical connection with the bulb filament, not shown, while the left pair 20 provides the positive connection. The socket assembly of the invention is low profile, yet provides for a uniform, reliable and non-damaging electrical contact with the filament contact wires 18 and 20. The invention 10 also has a reduced number of basic parts, as compared to many other low profile assemblies, including a housing, designated generally at 22 and a pair of identical barrel terminals, designated generally at 24. Each barrel terminal 24 has a circuit wire 26 crimped thereto as a unit, which in turn runs to the rest of the vehicle's electrical system, not shown. The circuit wires 26 exit the housing 22 in a low profile manner, perpendicular to the axis of the bulb 12, as best seen in FIG. 1. The basic parts will be described in detail in order below.

Referring now to FIGS. 2, 3 and 4, housing 22 is molded in one piece of plastic or other suitable dielectric material. Housing 22 has a central socket 28 therein formed, in part, by a pair of opposed walls 30, one respective to each opposed side of the lamp bulb base 14, and spaced apart an amount slightly greater that the thickness of the lower portion of bulb base 14. Socket 28 is thus adapted to closely receive the lamp bulb base 14 along a generally straight path, a path generally along the central axis of the lamp bulb 12, shown as a dotted line in FIGS. 1 and 4. This straight path reception is the major advantage of a wedge base type of lamp bulb. The housing 22 further includes a pair of substantially cylindrical barrel terminal passages 32 that open through one end of the housing 22. Each of the barrel terminal passages 32 has an axial orientation that is substantially perpendicular to the dotted line reception path of the lamp bulb base 14, and parallel to the socket walls 30. It may be understood, before barrel terminals 24 are described in detail, that the barrel terminal passages 32 need not have a diameter significantly larger than the diameter of the barrel terminals 24, and will thus present a minimal opening through housing 22, which may be more easily sealed. The orientation of the barrel terminal passages 32 allows each one of them to open laterally and longitudinally through a respective one of the socket walls 30. As best seen in FIG. 3, each barrel terminal passage 32 opens longitudinally through about two thirds of the length of a socket wall 30, and opens laterally by an amount that occupies less than one hundred and eighty degrees, for a reason described below. In addition, a slot 34 opens down through the top of housing 22 and through the inner surface of each barrel terminal passage 32, for a purpose also described below. Finally, housing 22 also has a cylindrical ground terminal passage 36 of larger diameter oriented parallel to and below the barrel terminal passages 32. A slot 38, best seen in FIG. 2, opens up through the bottom of housing 22 and through the inner surface of ground terminal passage 36. Ground terminal passage 36 cooperates with other structure, described next, that is not part of the invention in the broadest sense, but which is necessary to complete the electrical connection to bulb 12.

Referring now to FIGS. 2 and 4, a ground terminal, designated generally at 40, includes a generally U-shaped resilient front end 42, a circuit wire 44 crimped to its back end along with a ribbed seal 46, and an intermediate resilient tang 48 extending outwardly at an angle. Ground terminal 40 is pushed into ground terminal passage 36 along the dotted line seen in FIG. 4 until it seats. When seated, the tang 48 is resiliently captured and retained in slot 38 with the ribbed seal 46 filling up the open end of passage 36. U-shaped front end 42 is then presented within the housing socket 28. When the lower portion of bulb base 14 is received in housing socket 28 as described, the U-shaped front end 42 of ground terminal 40 resiliently and wipingly engages the right pair of filament contact wires 18, although that is not specifically illustrated. This establishes the ground electrical connection with bulb 12, as well as cooperating to retain bulb base 14 within socket 28. Although, not part of the invention in the broadest sense, an understanding of the ground terminal 40 provides a good foundation for understanding the advantages of the barrel terminals 24. Ground terminal 40 must be oriented as shown, and the diameter of passage 36 must be large enough to receive U-shaped front end 42, making it larger than the other passages 32, the accordingly larger diameter seal 46. The comparative advantages of the barrel terminals 24 will be described next.

Referring now to FIGS. 2, 3 and 4, the barrel terminals 24 are substantially cylindrical and hollow, and are roll formed in one piece from suitable conductive stock. Each barrel terminal 24 is formed with a plurality of of axial slits 50 therein, which extend from end to end thereof. Thus, the barrel terminals 24 may be uniformly radially inwardly compressed at any point on the circumference of their outer surface without substantial resistance. Each of the barrel terminals 24 has a diameter sized to be closely receivable within either of the barrel terminal passages 32. Each barrel terminal 24 also has three circumferentially spaced and backwardly sloped resilient tangs 52 near its inner end that extend radially outwardly. Tangs 52 are spaced approximately one hundred and twenty degrees apart. Finally, there is a ribbed seal 54 crimped to each barrel terminal 24 along with its circuit wire 26. Barrel terminals 24 are received into the housing 22 by pushing into the passages 32 along the dotted lines shown in FIG. 4. When fully seated, the ribbed seals 54 fill the open ends of passages 32, and it may be seen that seals 54 are smaller in diameter than the seal 46. The number of tangs 52 is sufficient that at least one will be resiliently captured in each slot 34, as best seen in FIG. 2. Thus, each barrel terminal 24 will be axially, or longitudinally, retained in its passage 32, regardless of circumferential orientation, which greatly simplifies assembly. Lateral retention is provided by the inner surfaces of the passages 32, which closely receive and wrap more than one hundred and eighty degrees of the barrel terminals 24. As a practical matter, the slots 34 and 38 would be filled or otherwise sealed once all terminals were in place. Importantly, the barrel terminals 24 present a contact surface through the socket walls 30 to the socket 28 that is laterally and longitudinally uniform or constant, regardless of their circumferential orientation.

Referring to FIG. 3, when the lower portion of bulb base 14 is received in the socket 28 as described above, the left pair of filament contact wires 20 will "see" the same contact surface of the barrel terminals 24, even if the bulb 12 is slightly off axis as it goes in. The base 14 moves between the barrel terminals 24, and the filament contact wires 20 wipe across the contact surfaces in a direction perpendicular to the axes of the barrel terminals 24. This may be referred to as a "cross-rod" interference fit. Consequently, the barrel terminals 24 are uniformly radially inwardly compressed between the filament contact wires 20 and the closely fitting inner surfaces of the passages 32 by the opposed base sides 16, as is best illustrated by comparing the dotted and solid lines in FIG. 3. Thus, a uniform and reliable electrical contact is made with the lamp bulb 12.

Variations of the preferred embodiment of the invention 10 may be made within the spirit of the invention. With a different wedge base bulb that had filament contact wires on one side only of its base, a single barrel terminal 24 could be used. Or, two more barrel terminals 24 could conceivably be used, received through the other end of housing 22. This would eliminate ground terminal 40, and give an assembly with a lower profile, though longer. There would be one more total terminals, of course, and the preferred embodiment disclosed is a compromise in that it has only three terminals total, although the ground terminal 40 does not provide the described advantages of the barrel terminals 24. Alternatively, the ground terminal 40 could be received through the other end of the housing 22, to again give a lower profile, though longer, assembly. Therefore, it will be understood that the invention is not intended to be limited to the preferred embodiment 10 disclosed.

The embodiments of the invention in which an exclusive property or privilege is claimed are defined as follows:

1. A low profile socket assembly for use with a lamp bulb of the type having a base with a contact element located externally on a side of said base, said assembly having a reduced number of parts while providing uniform and reliable electrical contact, comprising, a one piece housing having a socket therein adapted to receive said lamp bulb base along a generally straight path, said socket including a pair of opposed walls, one respective to each opposed side of said lamp bulb base, said housing further including a terminal passage with a substantially cylindrical inner surface, said terminal passage having an axial orientation that is substantially perpendicular to the path of said lamp bulb base and parallel to said socket walls so as to provide a low profile assembly, said orientation also allowing said terminal passage to open laterally and longitudinally through one of said socket walls, and, a substantially cylindrical and hollow one piece conductive terminal, said terminal having a plurality of axial slits therein so as to be radially inwardly compressible without substantial resistance, said terminal also being sized to be closely receivable within said terminal passage so as to be receivable into said housing with a uniform contact surface of said terminal being presented through said housing socket wall to said socket regardless of the orientation of said terminal in said terminal passage, said terminal thereby being uniformly compressible between said contact element and the inner surface of said terminal passage by said side of said lamp bulb base when said lamp bulb base is received into said socket so as to make uniform and reliable electrical contact with said lamp bulb.

2. A low profile socket assembly for use with a lamp bulb of the type having a base with contact elements located externally on opposed sides of said base, said assembly having a reduced number of parts while providing uniform and reliable electrical contact, comprising, a one piece housing having a socket therein adapted to receive said lamp bulb base along a generally straight path, said socket including a pair of opposed walls, one respective to each opposed side of said lamp bulb base, said housing further including a pair of terminal passages with substantially cylindrical inner surfaces, each of said terminal passages having an axial orientation that is substantially perpendicular to the path of said lamp bulb base and parallel to said socket walls so as to provide a low profile assembly, said orientation also allowing each of said terminal passages to open laterally and longitudinally through a respective one of said socket walls, and, a pair of substantially cylindrical and hollow one piece conductive terminals, each of said terminals having a plurality of axial slits therein so as to be radially inwardly compressible without substantial resistance, each of said terminals also being sized to be closely receivable within one of said terminal passages so as to be receivable into said housing with a uniform contact surface of said terminals being presented through each of said housing socket walls to said socket regardless of the orientation of said terminals in said terminal passages, whereby said lamp bulb base moves between said terminals when it base is received into said socket, said terminals thereby being uniformly compressible between said contact elements and the inner surfaces of said terminal passages by the opposed sides of said lamp bulb base, so as to make uniform and reliable electrical contact with said lamp bulb.

3. A low profile socket assembly for use with a lamp bulb of the type having a base with contact elements located externally on opposed sides of said base, said assembly having a reduced number of parts while providing uniform and reliable electrical contact, comprising, a one piece housing having a socket therein adapted to receive said lamp bulb base along a generally straight path, said socket including a pair of opposed walls, one respective to each opposed side of said lamp bulb base, said housing further including a pair of terminal passages with substantially cylindrical inner surfaces, each of said terminal passages having an axial orientation that is substantially perpendicular to the path of said lamp bulb base and parallel to said socket walls so as to provide a low profile assembly, said orientation also allowing each of said terminal passages to open laterally and longitudinally through a respective one of said socket walls, each of said terminal passages also having a slot opening through its inner surface, and, a pair of substantially cylindrical and hollow one piece conductive terminals, said terminals having a plurality of axial slits therein so as to be radially inwardly compressible without substantial resistance, each of said terminals also being sized to be closely receivable within one of said terminal passages and each of said terminals also having a sufficient number of circumferentially spaced flexible tangs extending radially outwardly therefrom so as to be receivable into said housing with a uniform contact surface of said terminals being presented through said housing socket walls to said socket and with at least one of said flexible tangs resiliently captured within said terminal passage slots to retain said terminals in said terminal passages regardless of the orientation of said terminals in said terminal passages, whereby said lamp bulb base moves between said terminals when it is received into said socket, said terminals thereby being uniformly compressible between said contact elements and the inner surfaces of said terminal passages by the opposed sides of said lamp bulb base, so as to make uniform and reliable electrical contact with said lamp bulb.

* * * * *

UNITED STATES PATENT AND TRADEMARK OFFICE

CERTIFICATE OF CORRECTION

PATENT NO. : 4,653,841

DATED : March 31, 1987

INVENTOR(S) : Robert G. Plyler and Charles R. Nestor

It is certified that error appears in the above-identified patent and that said Letters Patent is hereby corrected as shown below:

Title page, Assignee section, delete "Charles R. Nestor Niles".

Signed and Sealed this

Eighteenth Day of August, 1987

*Attest:*

DONALD J. QUIGG

*Attesting Officer*

*Commissioner of Patents and Trademarks*